US011524395B2

(12) United States Patent
Tanji

(10) Patent No.: US 11,524,395 B2
(45) Date of Patent: Dec. 13, 2022

(54) SIGNAL PROCESSING APPARATUS AND ELECTRIC TOOL

(71) Applicant: Panasonic Intellectual Property Management Co., Ltd., Osaka (JP)

(72) Inventor: Yusuke Tanji, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 121 days.

(21) Appl. No.: 17/043,959

(22) PCT Filed: Mar. 7, 2019

(86) PCT No.: PCT/JP2019/009035
§ 371 (c)(1),
(2) Date: Sep. 30, 2020

(87) PCT Pub. No.: WO2019/198392
PCT Pub. Date: Oct. 17, 2019

(65) Prior Publication Data

US 2021/0053196 A1 Feb. 25, 2021

(30) Foreign Application Priority Data

Apr. 10, 2018 (JP) ..... JP2018-075500

(51) Int. Cl.
*B25B 23/147* (2006.01)
*B25B 21/02* (2006.01)

(52) U.S. Cl.
CPC ..... *B25B 23/1475* (2013.01); *B25B 21/026* (2013.01)

(58) Field of Classification Search
CPC ..... B25B 23/1475; B25B 23/14–15; B25B 21/026; B25B 21/00; B25B 21/008
(Continued)

(56) References Cited

U.S. PATENT DOCUMENTS 4,096,743 A * 6/1978 Diamond ..... G01L 3/10 73/862.325
4,257,263 A * 3/1981 Herrgen ..... G01L 1/16 73/862.68

(Continued)

FOREIGN PATENT DOCUMENTS

JP S58-57676 A 4/1983
JP H11-267981 A 10/1999

(Continued)

OTHER PUBLICATIONS

International Search Report for corresponding Application No. PCT/JP2019/009035, dated May 7, 2019.

(Continued)

*Primary Examiner* — Dariush Seif
(74) *Attorney, Agent, or Firm* — Renner, Otto, Boisselle & Sklar, LLP

(57) ABSTRACT

A signal processing apparatus for an electric tool is provided for generating a motor control signal for controlling a motor by performing a smoothing process on a torque value signal from a torque sensor of an electric tool by using a filter. The signal processing apparatus includes a half width detector circuit that detects a half width of the torque value signal; and a calculator circuit that controls a cut-off frequency of the filter to change the cut-off frequency according to a number of hits of the electric tool, based on the detected half width of the torque value signal.

7 Claims, 14 Drawing Sheets

(58) Field of Classification Search
USPC ..... 173/173, 176, 181; 73/862.23, 862.21, 73/770, 862.08; 81/467, 479
See application file for complete search history.

(56) References Cited

U.S. PATENT DOCUMENTS 4,274,188 A * 6/1981 Eshghy ..... B25B 23/14 173/183
4,361,945 A * 12/1982 Eshghy ..... B23P 19/066 173/183
4,397,196 A * 8/1983 Lemelson ..... B25B 23/1425 702/43
4,558,601 A * 12/1985 Stasiek ..... B25B 23/1425 73/1.11
4,641,538 A * 2/1987 Heyraud ..... B25B 23/1425 73/862.26
4,643,030 A * 2/1987 Becker ..... B25B 23/14 73/770
5,315,501 A * 5/1994 Whitehouse ..... G05D 17/02 702/41
5,537,877 A * 7/1996 Hsu ..... B25B 23/1425 81/479
5,589,644 A * 12/1996 Becker ..... B25B 23/1425 73/862.21
6,070,506 A * 6/2000 Becker ..... B25B 23/1425 81/479
6,119,562 A * 9/2000 Jenkins ..... B25B 23/1427 81/479
6,167,788 B1 * 1/2001 Schonberger ..... B25B 23/14 81/429
6,234,051 B1 * 5/2001 Bareggi ..... B25B 23/0035 81/479
6,341,535 B1 * 1/2002 Yasui ..... G01L 3/105 73/862.333
6,345,436 B1 * 2/2002 Codrington ..... B25B 23/10 81/437
6,456,090 B1 * 9/2002 Ishikawa ..... G01L 3/105 73/862.331
6,526,853 B2 * 3/2003 Jenkins ..... B25B 23/1427 81/479
6,698,298 B2 * 3/2004 Tsuji ..... B25B 23/14 73/862.21
6,968,759 B2 * 11/2005 Becker ..... B25B 23/1425 81/479
7,000,508 B2 * 2/2006 Li ..... B25B 23/1425 81/475
7,047,849 B2 * 5/2006 Lai ..... B25B 23/1425 81/479
7,089,834 B2 * 8/2006 Reynertson ..... B25B 23/14 81/479
8,924,134 B2 * 12/2014 Tanaka ..... G01L 23/225 701/111
9,423,786 B2 * 8/2016 Imada ..... G05B 13/0265
10,985,684 B2 * 4/2021 Kishimoto ..... H02P 23/18
2002/0050364 A1 * 5/2002 Suzuki ..... B25F 5/00 173/1
2002/0170395 A1 * 11/2002 Wang ..... B25B 23/1425 81/467
2002/0178876 A1 * 12/2002 Wang ..... B25B 23/1425 81/467
2004/0255733 A1 * 12/2004 Reynertson, Jr. ... B25B 23/1425 81/467
2005/0061119 A1 * 3/2005 Becker ..... B25B 23/1425 81/467
2005/0072278 A1 * 4/2005 Cutler ..... B25B 23/1425 81/467
2005/0092143 A1 * 5/2005 Lehnert ..... B25B 23/1425 81/469
2005/0223856 A1 * 10/2005 Reynertson ..... B25B 23/1425 81/467
2007/0119267 A1 * 5/2007 Anjanappa ..... B25B 23/1425 73/862.21
2009/0250233 A1 * 10/2009 Wallace ..... B25B 23/1405 173/183
2011/0106394 A1 * 5/2011 Buslepp ..... F02D 41/3035 701/102
2011/0245980 A1 * 10/2011 Nessjoen ..... G05D 19/02 702/9
2013/0014967 A1 * 1/2013 Ito ..... B25F 5/00 173/93
2013/0062086 A1 * 3/2013 Ito ..... B25B 23/1475 173/1
2013/0112494 A1 * 5/2013 Aoki ..... G01L 3/104 73/862.331
2014/0033811 A1 * 2/2014 Hoffmann ..... F02D 41/2096 73/114.49
2014/0102219 A1 * 4/2014 Kuwahara ..... B62D 5/0481 73/862.333
2014/0152207 A1 * 6/2014 Sasaki ..... H02P 21/22 318/400.02
2014/0312812 A1 * 10/2014 Sasaki ..... H02P 21/0089 318/400.02
2015/0226627 A1 * 8/2015 Kuwahara ..... G01L 3/105 701/41
2015/0231770 A1 * 8/2015 Kusakawa ..... B25B 21/02 173/93.5
2016/0344326 A1 * 11/2016 Fujiwara ..... G05B 13/042
2017/0008156 A1 * 1/2017 Miyazaki ..... B25B 23/1475
2017/0217001 A1 * 8/2017 Oishi ..... B25B 21/02
2018/0272511 A1 * 9/2018 Sako ..... B25B 23/1475
2020/0384618 A1 * 12/2020 Tanji ..... B25B 21/02

FOREIGN PATENT DOCUMENTS

JP 2004-322809 A 11/2004
JP 2004-351983 A 12/2004
JP 2005-174396 A 6/2005
JP 2008-083002 A 4/2008
JP 2008-284618 A 11/2008
JP 2013-220507 A 10/2013
JP 2014-127903 A 7/2014

OTHER PUBLICATIONS

Office Action and Search Report for corresponding CN Application No. 201980024364.4, with English translation of Search Report only, dated Jul. 15, 2021.
Extended European Search Report for corresponding Application No. 19784710.6, dated Mar. 29, 2021.
Office Action for corresponding Japanese Application No. 2020-513122 dated Feb. 1, 2022 and its English translation.
International Preliminary Report on Patentability corresponding Application No. PCT/JP2019/009035, dated Oct. 22, 2020.
Office Action for corresponding Japanese Application No. 2020-513122 dated Jun. 7, 2022 and its English translation.

* cited by examiner

SIGNAL PROCESSING APPARATUS AND ELECTRIC TOOL

TECHNICAL FIELD

The present disclosure relates to a signal processing apparatus for an electric tool that includes a rotating body that rotates by being hit by a driving apparatus, and an electric tool that includes the signal processing apparatus.

BACKGROUND ART

There has been known an electric tool (hereinafter, also referred to as an "impact electric tool") including a rotating body that rotates by being hit by a driving apparatus, such as an impact driver and an impact wrench.

Patent Document 1 discloses an impact electric tool, in which a motor rotationally drives a hammer, and a hit torque generated by the hammer is applied to an object to be tightened to generate a tightening torque.

PRIOR-ART DOCUMENTS

Patent Documents

[Patent Document 1] Japanese Patent Laid-open Publication No. JP2008-083002A

SUMMARY OF THE INVENTION

Problems to be Solved by the Invention

Some impact electric tools control driving apparatuses such as motors based on the torque applied to rotating bodies. However, when measuring the torque applied to the rotating body by a torque sensor built in an impact electric tool, a torque value signal indicating the torque includes noise components (components that do not contribute to a torque value) due to a hit applied to the rotating body of the impact electric tool, and is called a "torque value signal". Due to these noise components, there is possibility that the driving apparatus is not controlled accurately. Therefore, when measuring the torque applied to the rotating body of the impact electric tool, it is required to obtain an accurate torque value signal.

An object of the present disclosure is to solve the above problems, and to provide a signal processing apparatus capable of generating a torque value signal with higher accuracy compared with the prior art, and an electric tool including the signal processing apparatus.

Means for Solving the Problems

According to the present disclosure, a signal processing apparatus is provided that generates a motor control signal for controlling a motor by performing a smoothing process on a torque value signal from a torque sensor of an electric tool by using a filter. The signal processing apparatus includes a half width detector circuit that detects a half width of the torque value signal, and a calculator circuit that controls a cut-off frequency of the filter to change the cut-off frequency according to a number of hits of the electric tool, based on the detected half width of the torque value signal.

Effect of the Invention

Therefore, the signal processing apparatus of the present disclosure can generates the torque value signal with a precision higher than that of the prior art.

MODE FOR CARRYING OUT THE INVENTION

Figure 1:
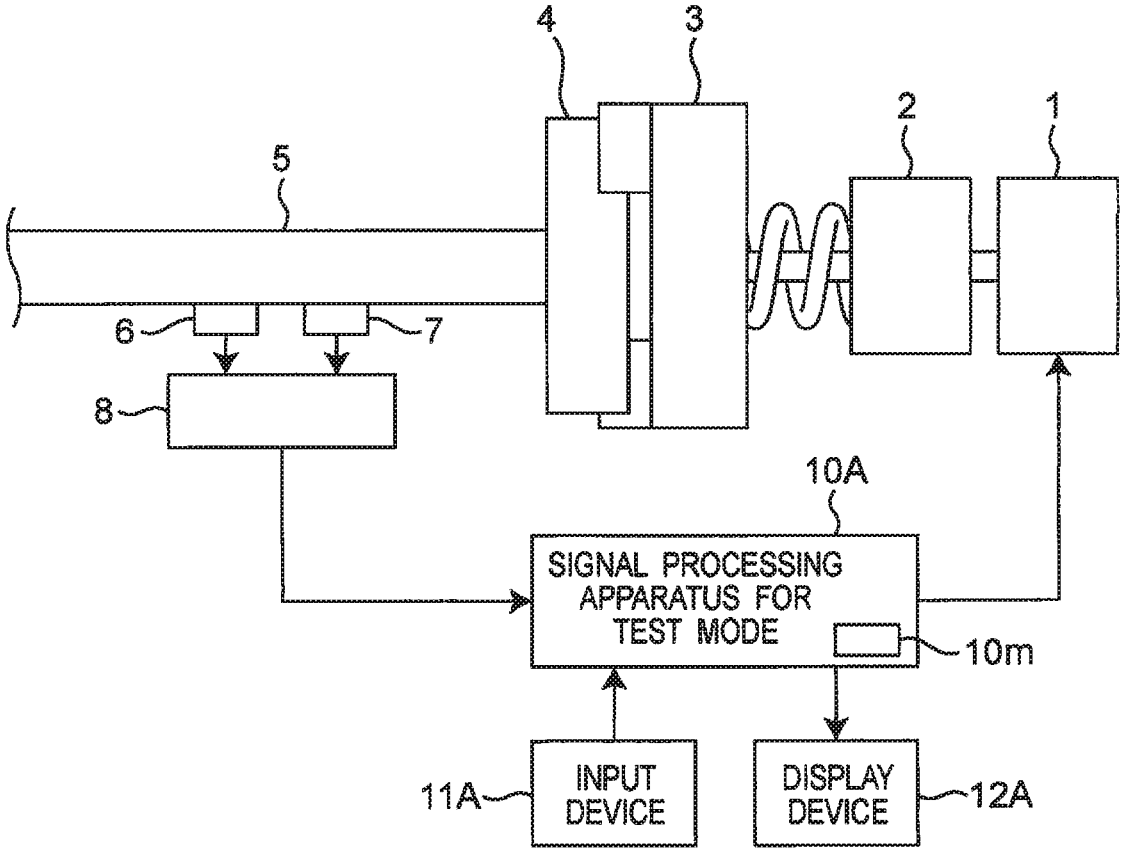
FIG. 1 is a schematic block diagram illustrating a configuration example in a test mode of an impact electric tool according to an embodiment.

Hereinafter, an embodiment of the present disclosure will be described with reference to the drawings. It is noted that in the drawings, identical reference characters denote identical or similar components, and a detailed description thereof will be omitted.

First of all, the configuration and the operation of an impact electric tool in a test mode according to the embodiment will be described below.

FIG. 1 is a schematic block diagram illustrating a configuration example in the test mode of the impact electric tool according to the embodiment. Referring to FIG. 1, the impact electric tool includes a motor 1, a speed reducer 2, a hammer 3, an anvil 4, a shaft 5, a torque sensor 6, an impact sensor 7, a split ring 8, a signal processing apparatus 10A for test mode having an internal memory 10*m*, an input device 11A, and a display device 12A. The impact electric tool of FIG. 1 is an impact driver or the like including a rotating body that rotates by being hit by applying as a driving signal a motor control signal in a test mode from the signal processing apparatus 10A for test mode to the motor 1.

It is noted that each of the signal processing apparatus 10A for test mode and a signal processing apparatus 10 for operation mode to be described later is configured to include a controller such as a digital calculator, and the signal processing apparatus 10A for test mode may be built in the signal processing apparatus 10 for operation mode.

The anvil 4 and the shaft 5 are integrally formed to each other. At a front end of the shaft 5 (end part opposite to the anvil 4), a bit holder (not shown) that accommodates a driver bit is provided. The speed reducer 2 decelerates rotation generated by the motor 1 and transmits the rotation to the hammer 3. The hammer 3 applies a hitting force to the anvil 4 to rotate the anvil 4 and the shaft 5.

The torque sensor 6 and the impact sensor 7 are fixed to the shaft 5. The torque sensor 6 detects a torque applied to the shaft 5, and outputs a torque value signal St indicating the detected torque. The torque sensor 6 includes, for example, a strain sensor, a magnetostrictive sensor, or the like. The impact sensor 7 detects impact applied to the shaft 5 due to a hit given to the anvil 4 and the shaft 5, and outputs an impact pulse indicating the detected impact as a pulse. The impact sensor 7 includes, for example, an acceleration sensor, a microphone, or the like.

The split ring 8 transfers a torque value signal St and an impact pulse from the shaft 5 to the signal processing apparatus 10A provided in the non-movable part of the tool.

The input device 11A receives a user set value indicating an additional parameter regarding operation of the tool from the user and sends the user set value to the signal processing apparatus 10A. The additional parameter includes, for example, at least one of the type of socket of the tool, the type of object to be fastened, and the bolt diameter. The type of socket includes a socket length such as 40 mm, 250 mm, or the like. The type of object to be fastened includes, for example, a hard joint and a soft joint. The bolt diameter includes, for example, M8, M12, M14 and the like. The display device 12A displays the state of the tool, for example, the input user set value, the torque applied to the shaft 5, and the like. The signal processing apparatus 10A drives and controls the motor 1 based on the torque value signal St, the impact pulse, and the user set value. The motor 1 applies a hit on the anvil 4 and the shaft 5 under the control of the signal processing apparatus 10A.

In the present disclosure, the anvil 4, the shaft 5, and the bit holder (not shown) are also referred to as a "rotating body". In addition, in the present disclosure, the motor 1, the speed reducer 2, and the hammer 3 are also referred to as a "driving apparatus".

Figure 2:
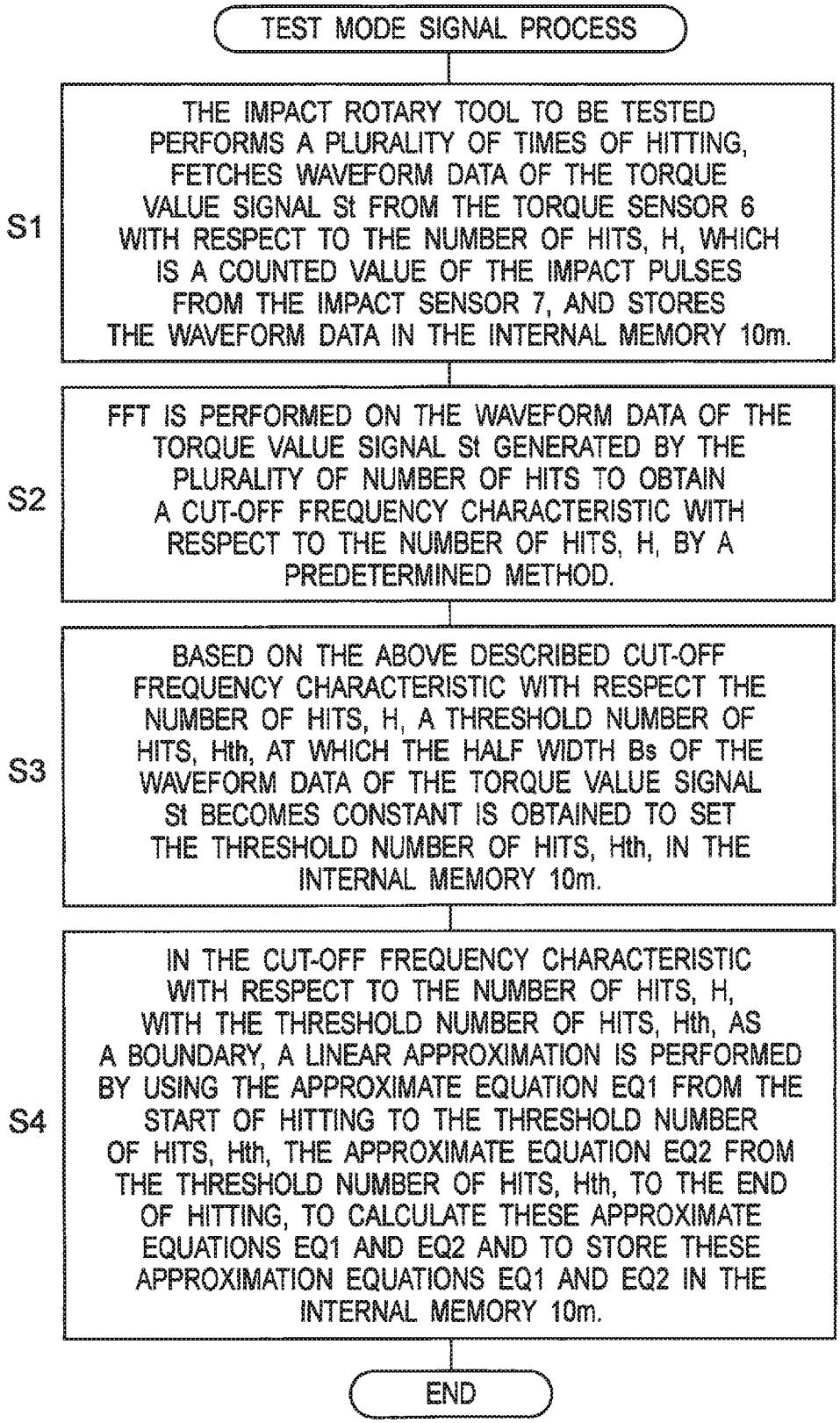
FIG. 2 is a flowchart illustrating a test mode signal process executed by a signal processing apparatus 10A for test mode of FIG. 1.
Figure 3:
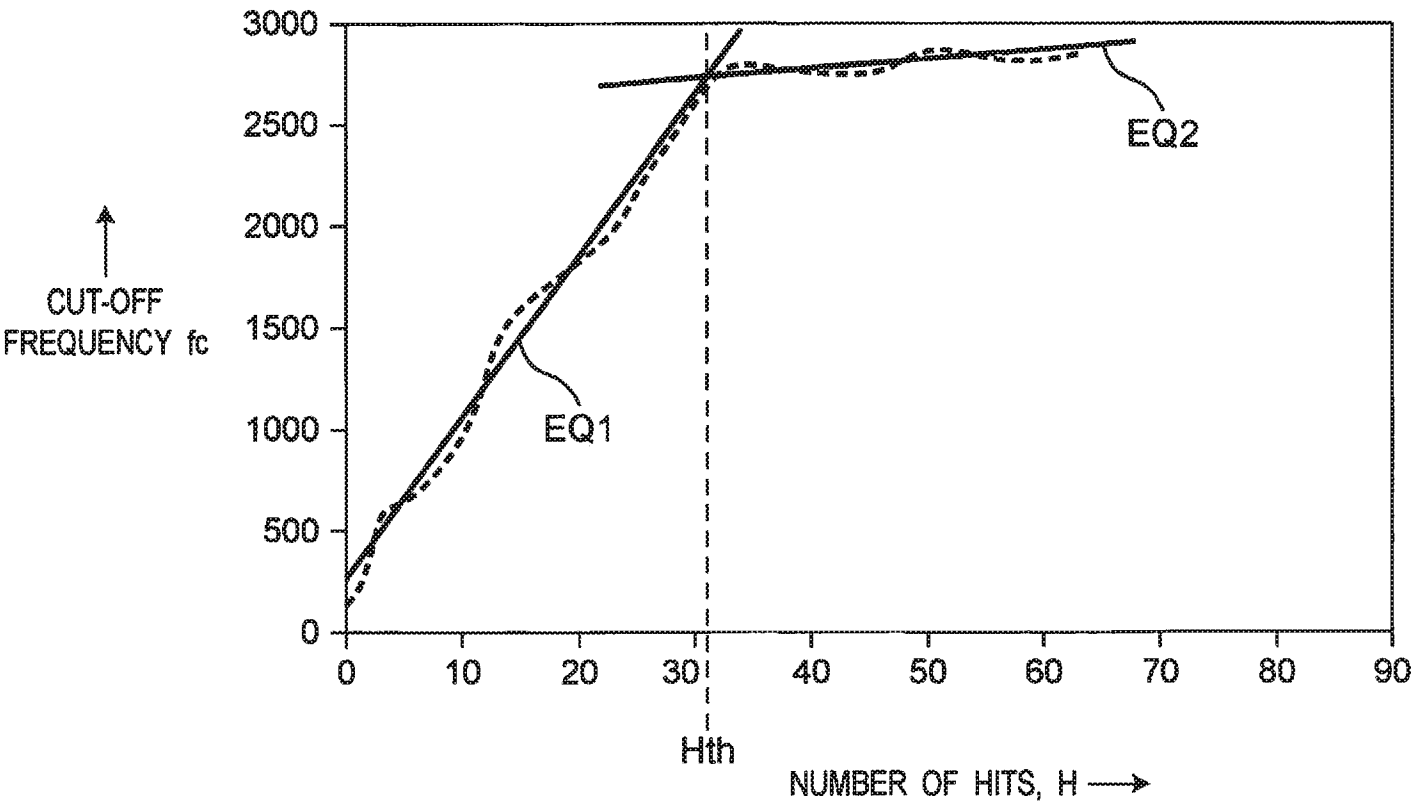
FIG. 3 is a graph illustrating an example of a number-of-hits characteristic with respect to a cut-off frequency fc in the impact electric tool of FIG. 1.

FIG. 2 is a flowchart illustrating a test mode signal process executed by the signal processing apparatus 10A for test mode of FIG. 1. In addition, FIG. 3 is a graph illustrating an example of a number-of-hits characteristic with respect to a cut-off frequency fc in the impact electric tool of FIG. 1. It is noted that the cut-off frequency fc is the cut-off frequency fc of a digital low-pass filter (digital LPF) 22 of FIG. 17 to be described later, and the digital low-pass filter 22 executes smoothing processing for removing the noise components of a strike waveform from a torque value signal St including the strike waveform. In addition, according to the experiment performed by the inventors, as illustrated in FIG. 3, the cut-off frequency fc with respect to the number of hits H has a characteristic of increasing in accordance an increase in the number of hits H, and then, becoming almost constant at a predetermined threshold number of hits Hth (at this time, the half width of the torque value signal St also becomes constant as will be described later) to reach the maximum.

In step S1 of FIG. 2, the impact rotary tool to be tested performs a plurality of times of hitting to fetch waveform data of the torque value signal (including strike waveform) St from the torque sensor 6 with respect to the number of hits H, which is a counted value of the impact pulses from the impact sensor 7, and to store the waveform data in the internal memory 10*m*. Next, in step S2, FFT (Fast Fourier Transform) is performed on the waveform data of the torque value signal St generated by the plurality of number of hits to obtain a cut-off frequency characteristic with respect to the number of hits H by a method described later in detail.

Further, in step S3, from the above described cut-off frequency characteristic with respect the number of hits H (FIG. 3), a threshold number of hits Hth (see FIG. 3), at which the half width Bs of the waveform data of the torque value signal St becomes constant, is obtained to set the threshold number of hits Hth in the internal memory 10*m*. In step S4, in the cut-off frequency characteristic with respect to the number of hits H, with the threshold number of hits Hth as a boundary, as illustrated in FIG. 3, a linear approximation is performed by using the following equations:

(1) the approximate equation EQ1 from the start of hitting to the threshold number of hits Hth; and (2) the approximate equation EQ2 from the threshold number of hits Hth to the end of hitting, to calculate these approximate equations EQ1 and EQ2, and to store these approximation equations EQ1 and EQ2 in the internal memory 10*m*. Thus, the test mode signal process is terminated.

As will be described later in detail, the present embodiment is characterized by determining the cut-off frequency fc by using the approximate equation EQ1 until the half width Bs of the torque value signal St becomes constant, while determining the cut-off frequency fc by using the approximate equation EQ2 after the half width Bs of the torque value signal St becomes constant (the number of hits H exceeds the predetermined threshold number of hits Hth).

Figure 4:
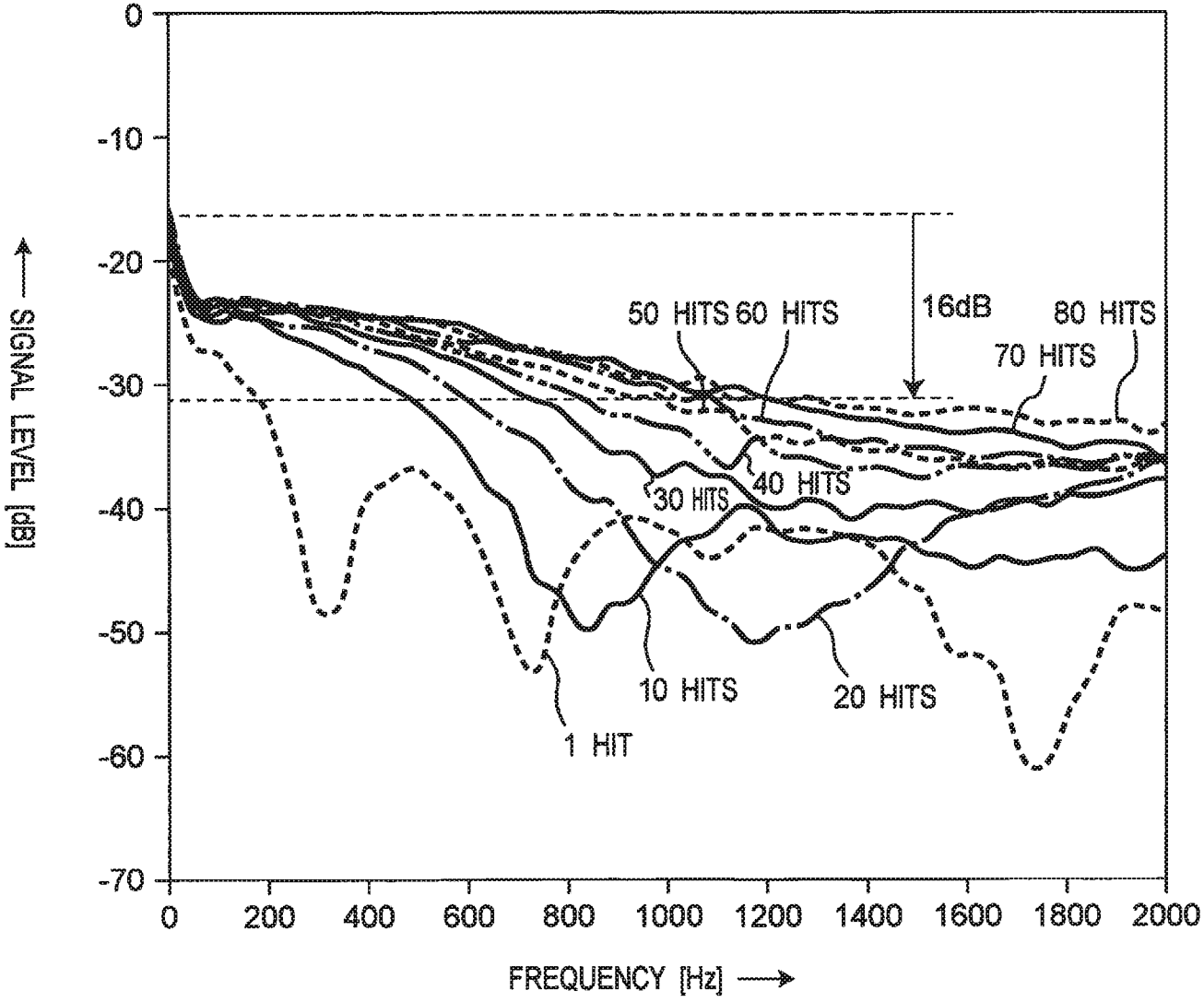
FIG. 4 is a graph for explaining a method of determining the cut-off frequency fc according to the embodiment.

FIG. 4 is a graph for explaining in detail a method of determining the cut-off frequency fc according to the embodiment. In the embodiment, the cut-off frequency fc is set to such a frequency that the torque value signal St is lower by predetermined signal level than the peak of the frequency spectrum the torque value signal St, that is, by 16 dB in the example of FIG. 4. As described above, when a certain screw or bolt is fastened by the impact driver, the frequency components on the higher frequency side of the torque value signal St gradually increase as the number of hits counted from the start of fastening increases. Therefore, the cut-off frequency fc also increases in accordance with an increase in the number of hits.

Figure 5:
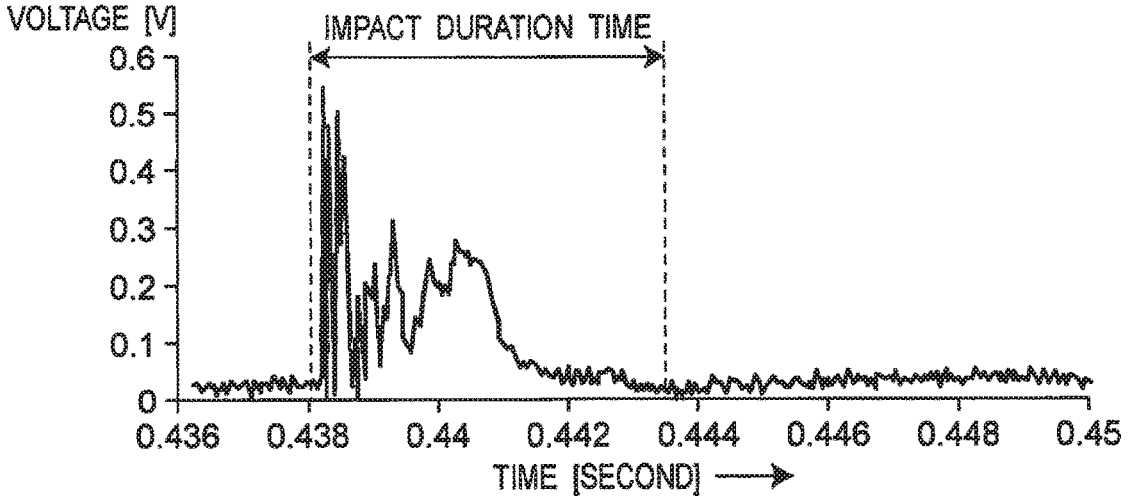
FIG. 5 is a waveform diagram of a torque value signal in a first hit.
Figure 6:
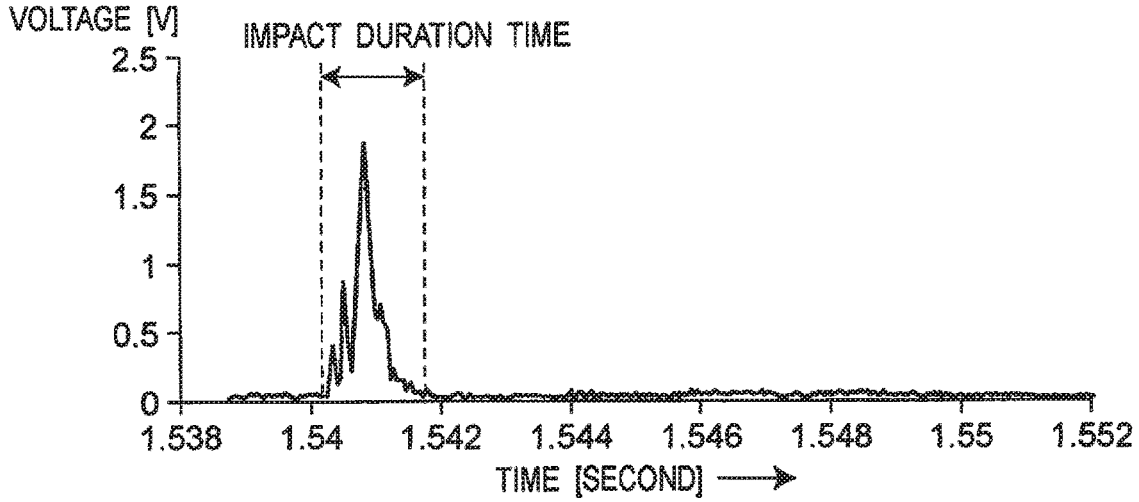
FIG. 6 is a waveform diagram of a torque value signal in a 44th hit.
Figure 7:
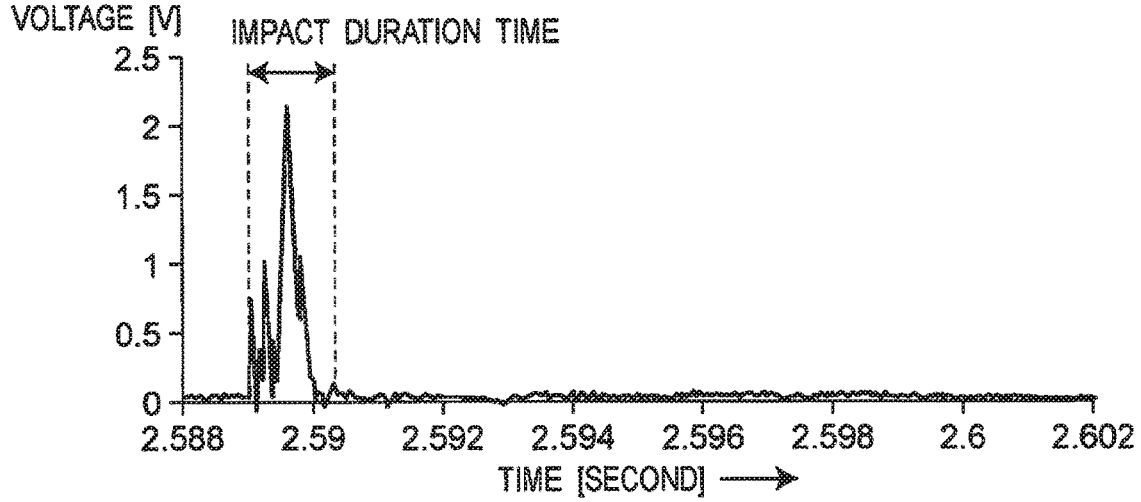
FIG. 7 is a waveform diagram of a torque value signal in an 84th hit.

FIG. 5 is a waveform diagram of the torque value signal St in a first hit. FIG. 6 is a waveform diagram of the torque value signal St in a 44th hit. FIG. 7 is a waveform diagram of the torque value signal St in an 84th hit. In the cases of FIGS. 5 to 7, as the user set values, the socket type "socket length 40 mm", the type of object to be fastened "hard joint", and the bolt diameter "M14" were used. As can be seen from FIGS. 5 to 7, the impact duration time decreases in accordance with an increase in the number of hits. In addition, at this time, the frequency components on the higher frequency side of the torque value signal St gradually increase in accordance with an increase in the number of hits.

Figure 8:
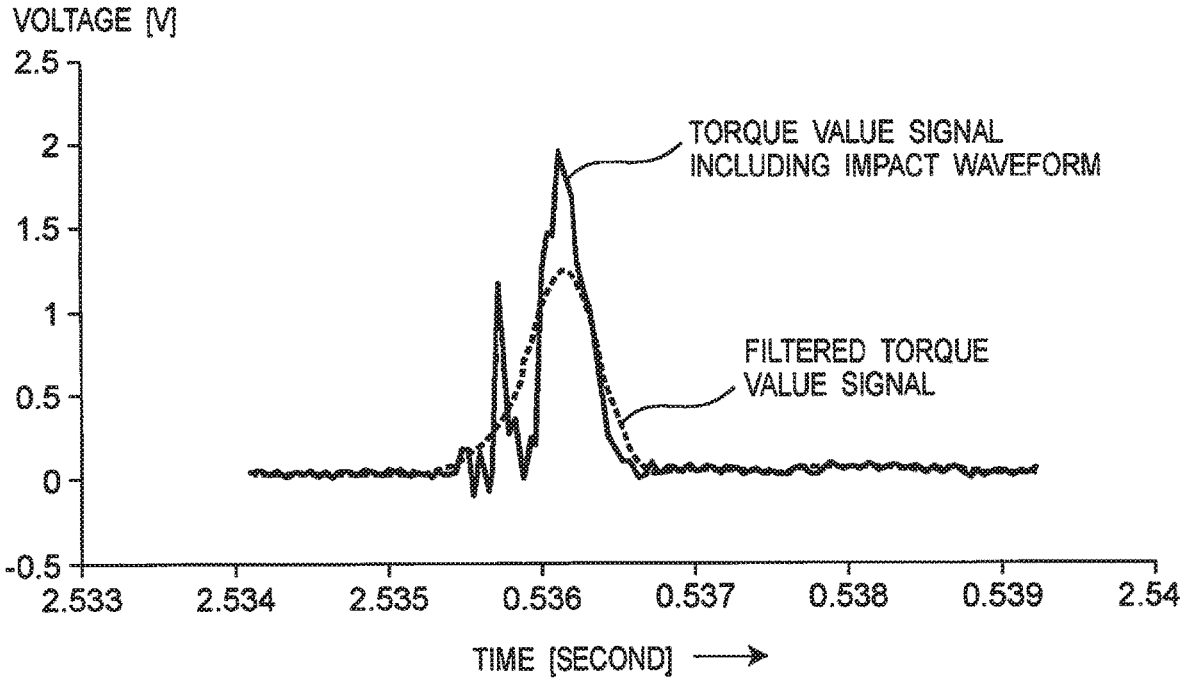
FIG. 8 is a graph illustrating filtering of a torque value signal according to the embodiment.

FIG. 8 is a graph illustrating filtering of the torque value signal St according to the embodiment. The cut-off frequency fc determined as described above is used to obtain a torque value signal Sts, which is filtered so as to reduce the noise components.

Figure 9:
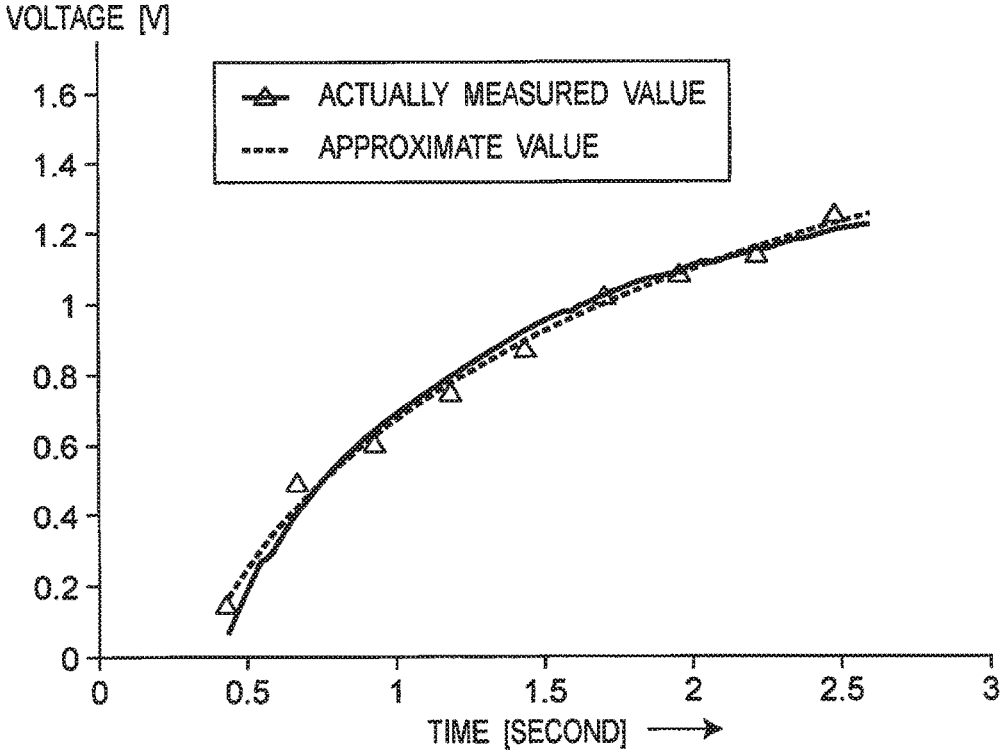
FIG. 9 is a graph of comparing a torque value signal filtered by using the cut-off frequency fc determined according to the embodiment with an actually measured torque value signal.

FIG. 9 is a graph for comparing the torque value signal Sts filtered by using the cut-off frequency fc determined according to the embodiment with an actually measured torque value signal St. The graph of FIG. 9 indicates the value of the torque value signal St when the 40 hits per second are applied to the anvil 4 and the shaft 5. The solid line indicates the torque value actually measured by an external measuring instrument. Triangular plots indicate values of the filtered torque value signal St in 10th, 20th, . . . , 90th hits. The broken line indicates an approximate equation for the value of the filtered torque value signal St: $y=a\times\ln(x)+b$. In this case, "x" represents time (corresponding to the number of hits), "y" represents a voltage, and "a" and "b" represent coefficients that change according to the additional parameters. As can be seen in FIG. 9, the value of the filtered torque value signal St is in good agreement with the actually measured torque value.

Modified Embodiment

The cut-off frequency of the filter 22 may be determined by a criterion other than the criterion described above.

Figure 10:
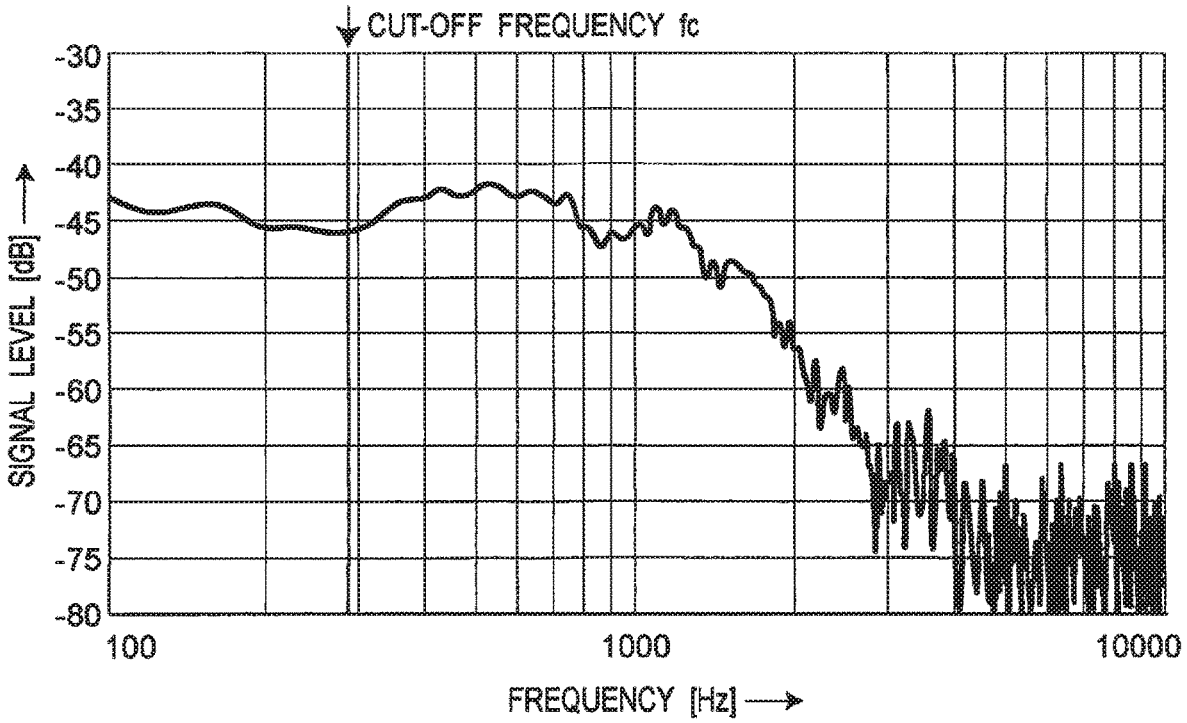
FIG. 10 is a graph for explaining a method of determining the cut-off frequency fc of the torque value signal in an impact electric tool according to a modified embodiment, and the graph illustrating a frequency spectrum of a torque value signal in a first hit.
Figure 11:
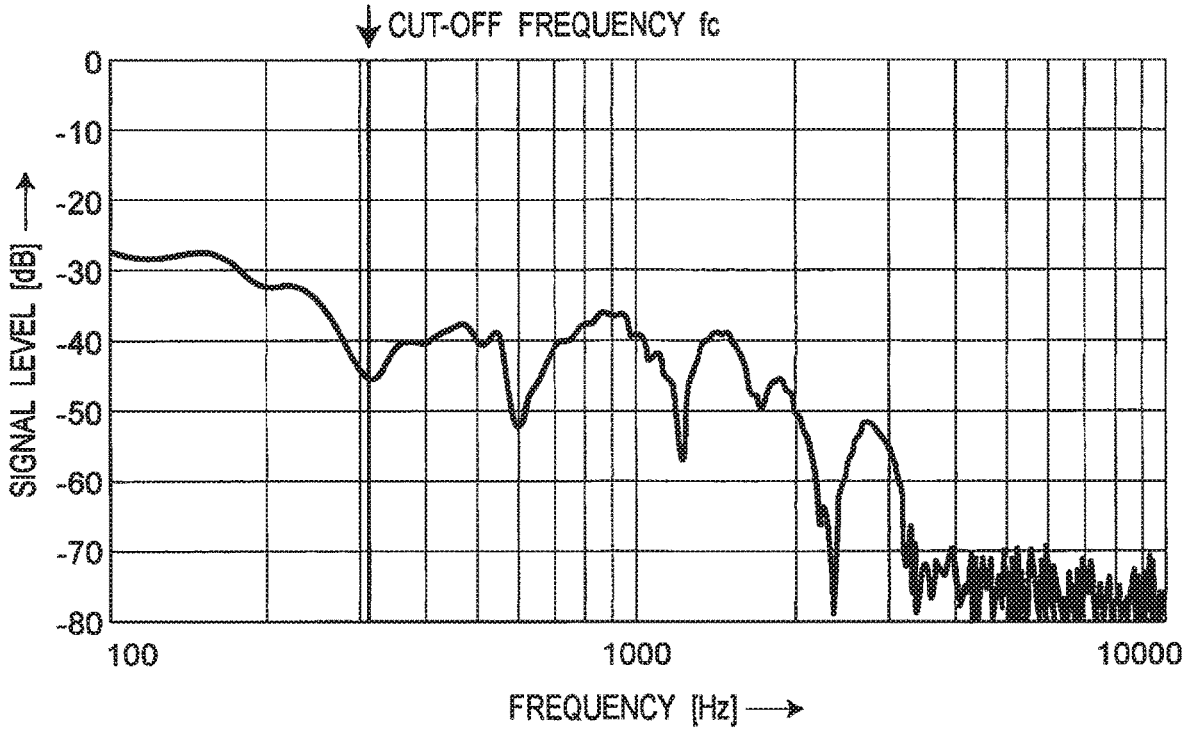
FIG. 11 is a graph for explaining the method of determining the cut-off frequency fc of the torque value signal in the impact electric tool according to the modified embodiment, and the graph illustrating a frequency spectrum of the torque value signal in a fifth hit.
Figure 12:
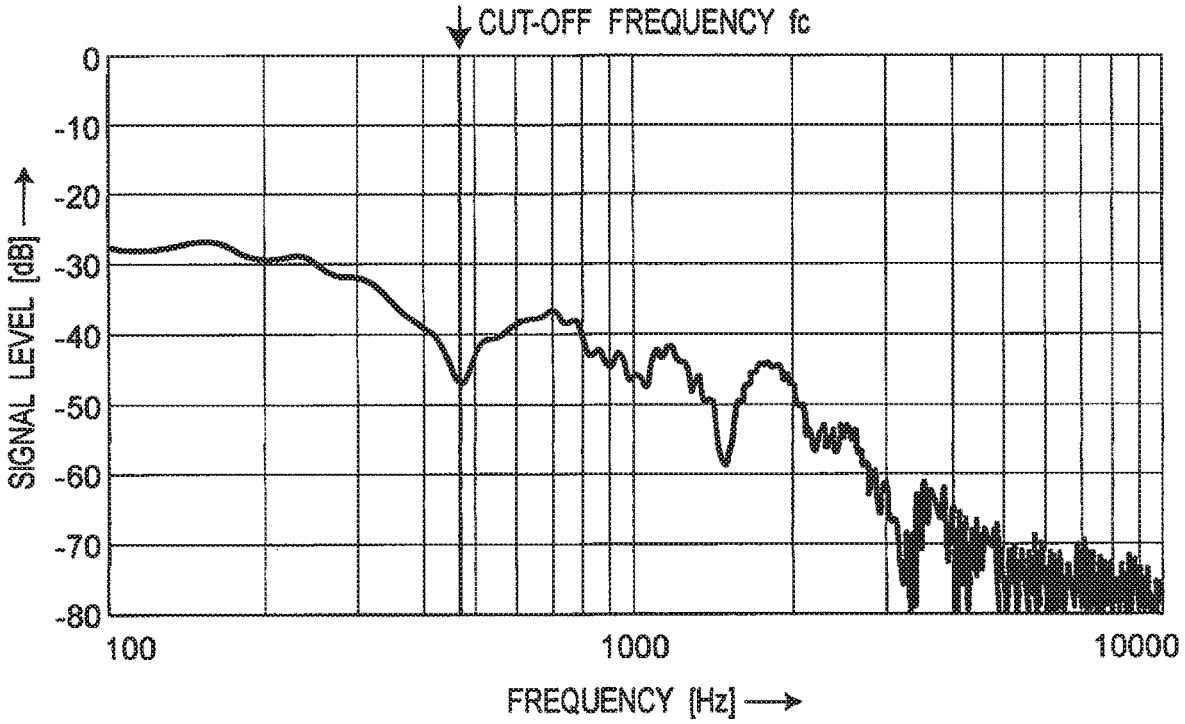
FIG. 12 is a graph for explaining the method of determining the cut-off frequency fc of the torque value signal in the impact electric tool according to the modified embodiment, and the graph illustrating a frequency spectrum of the torque value signal in a tenth hit.
Figure 13:
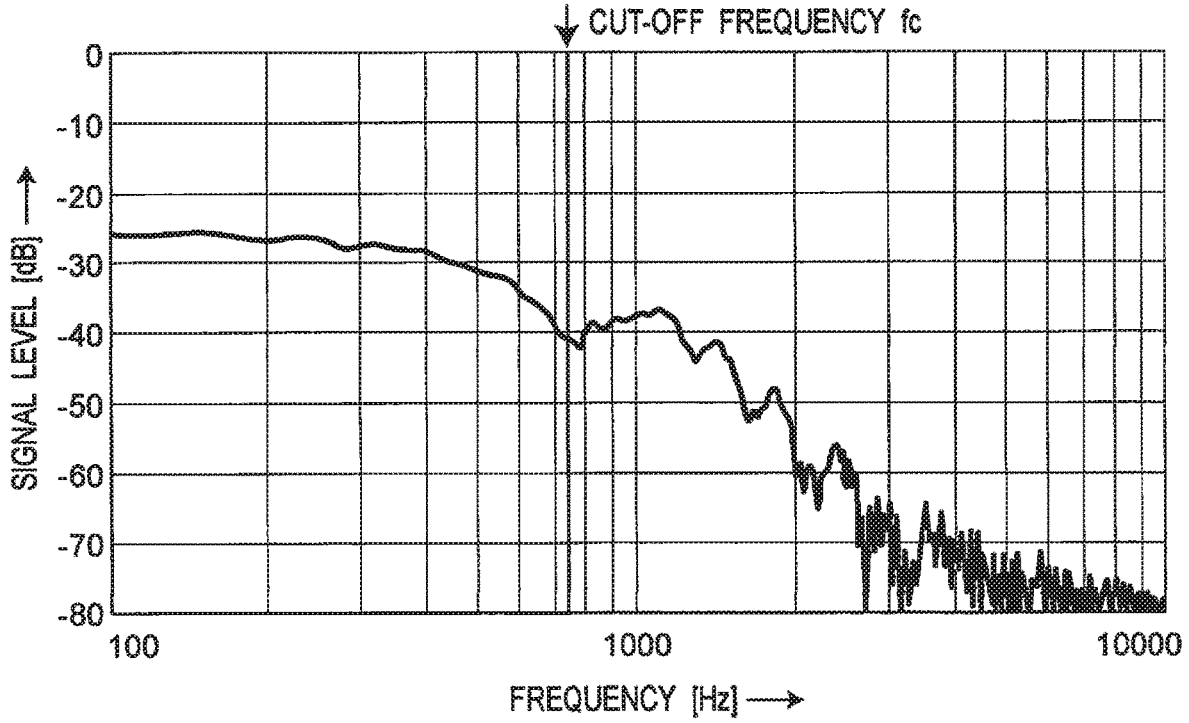
FIG. 13 is a graph for explaining the method of determining the cut-off frequency fc of the torque value signal in the impact electric tool according to the modified embodiment, and the graph illustrating a frequency spectrum of the torque value signal in a 20th hit.
Figure 14:
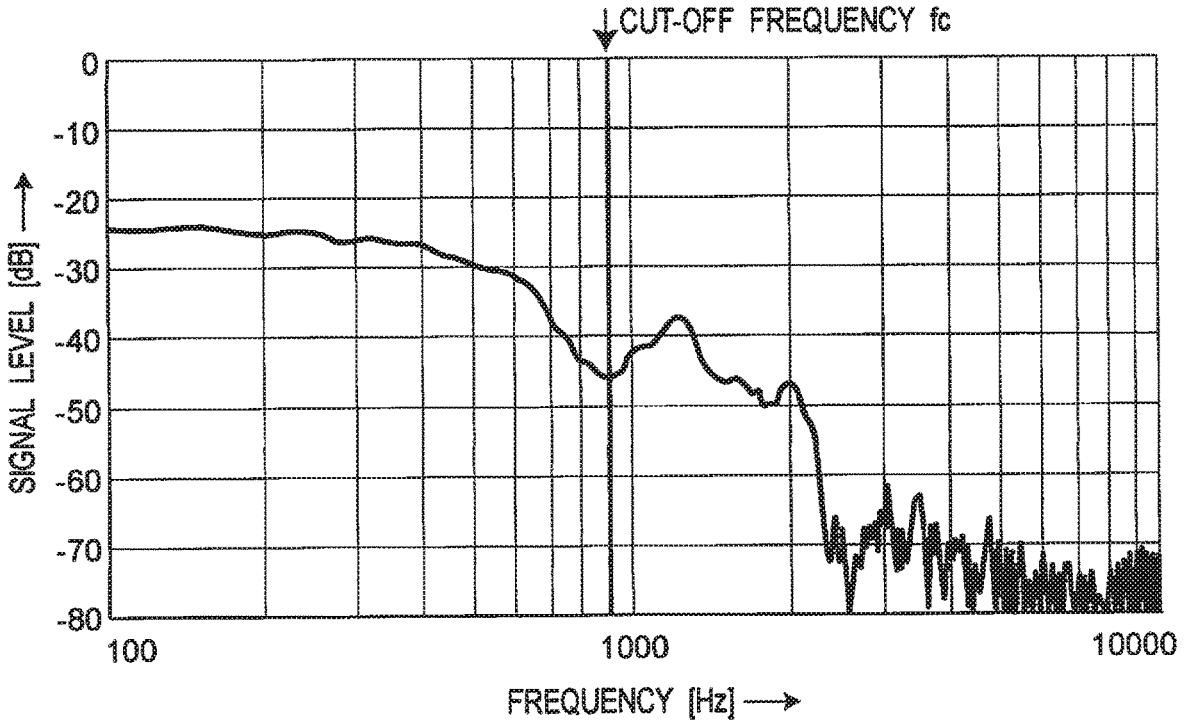
FIG. 14 is a graph for explaining the method of determining the cut-off frequency fc of the torque value signal in the impact electric tool according to the modified embodiment, and the graph illustrating a frequency spectrum of the torque value signal in a 30th hit.
Figure 15:
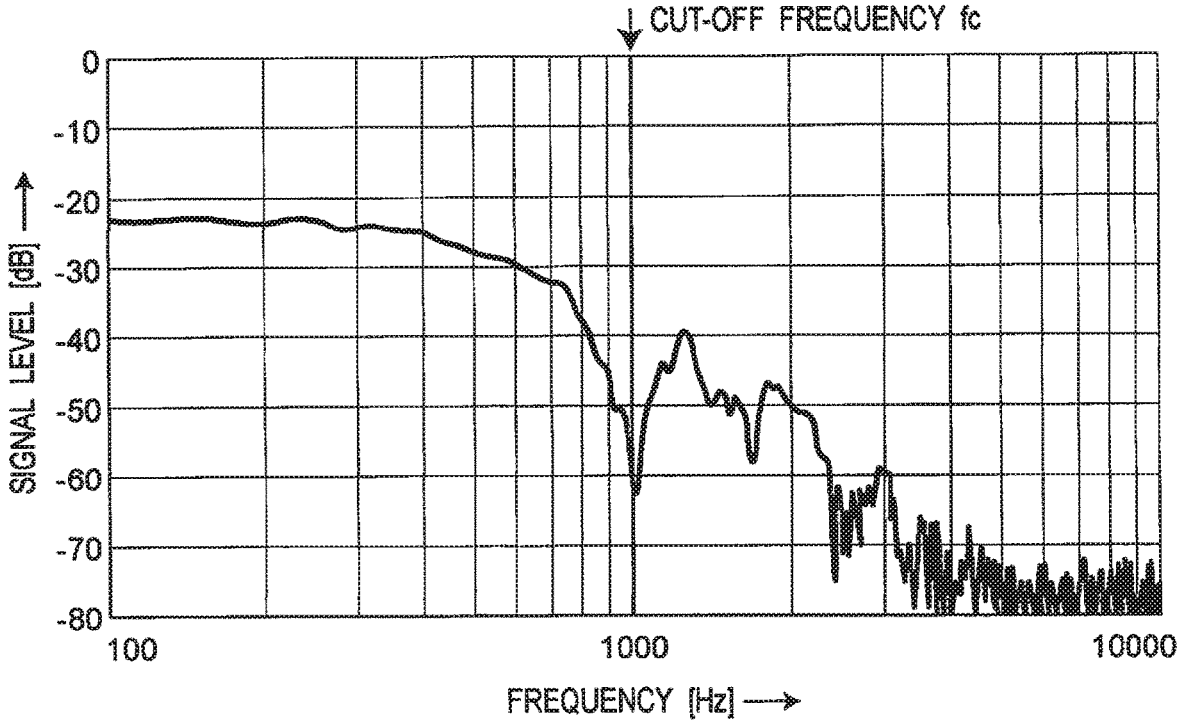
FIG. 15 is a graph for explaining the method of determining the cut-off frequency fc of the torque value signal in the impact electric tool according to the modified embodiment, and the graph illustrating a frequency spectrum of the torque value signal in a 40th hit.

FIGS. 10 to 15 are graphs for explaining a method of determining the cut-off frequency of a torque value signal St in a tool according to a modified embodiment. FIG. 10 is a graph illustrating a frequency spectrum of the torque value signal St in a first hit. FIG. 11 is a graph illustrating a frequency spectrum of the torque value signal St in a fifth hit. FIG. 12 is a graph illustrating a frequency spectrum of the torque value signal St in a tenth hit. FIG. 13 is a graph illustrating a frequency spectrum of the torque value signal St in a 20th hit. FIG. 14 is a graph illustrating a frequency spectrum of the torque value signal St in a 30th hit. FIG. 15 is a graph illustrating a frequency spectrum of the torque value signal St in a 40th hit. As described above, when a certain screw or bolt is fastened by the impact driver, the frequency components on the higher frequency side of the torque value signal St gradually increase as the number of hits counted from the start of fastening increases. In the modified embodiment, the cut-off frequency fc is set to such a frequency that the signal level reaches the first minimum value by searching from the low frequency band to the high frequency band in the frequency spectrum of the torque value signal St.

Next, the configuration and the operation of the impact electric tool in an operation mode according to the embodiment will be described below.

Figure 16:
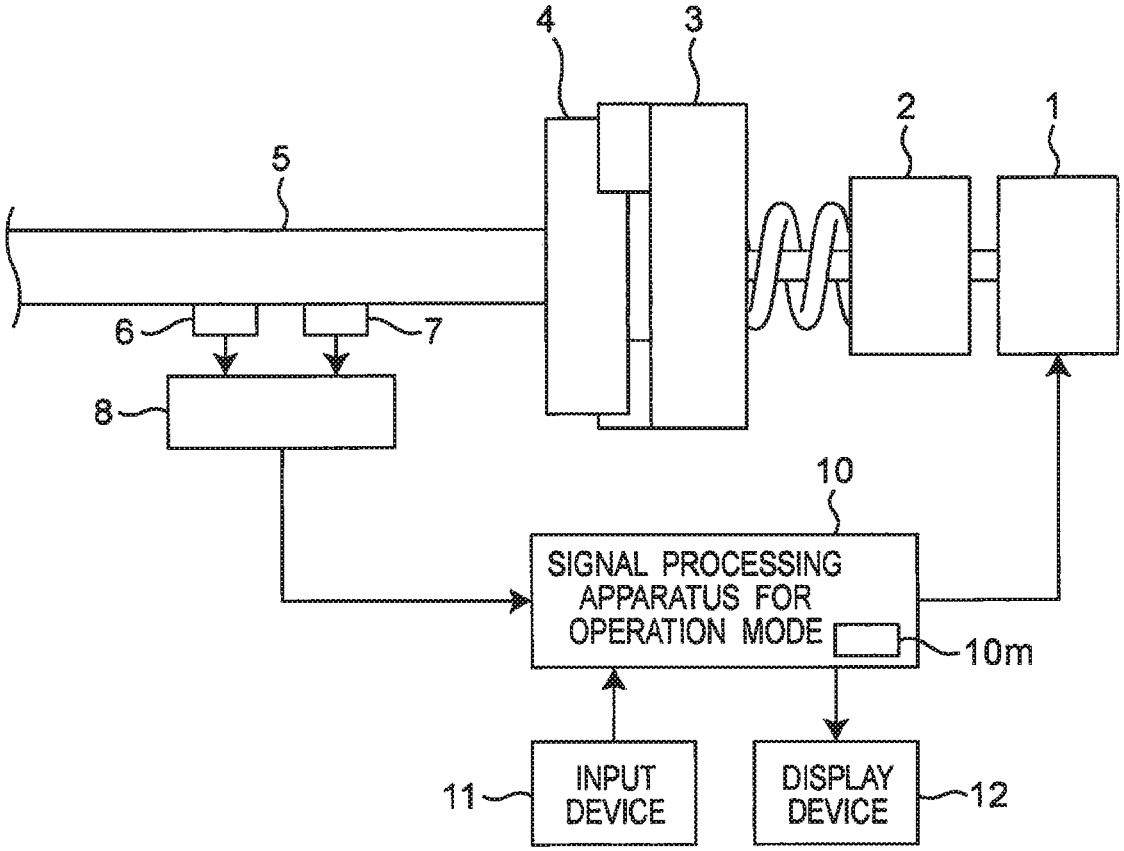
FIG. 16 is a schematic block diagram illustrating a configuration example in an operation mode of the impact electric tool according to the embodiment.

FIG. 16 is a schematic block diagram illustrating a configuration example in an operation mode of the impact electric tool according to the embodiment. Referring to FIG. 16, the impact electric tool includes the motor 1, the speed reducer 2, the hammer 3, the anvil 4, the shaft 5, the torque sensor 6, the impact sensor 7, the split ring 8, a signal processing apparatus 10 for operation mode having an internal memory 10*m*, an input device 11, and a display device 12. The impact electric tool of FIG. 16 is different from the impact electric tool of FIG. 1, in that the impact electric tool of FIG. 16 includes the signal processing apparatus 10 for operation mode, the input device 11, and the display device 12, instead of the signal processing apparatus 10A for test mode, the input device 11A, and the display device 12A. The differences will be described below.

Figure 17:
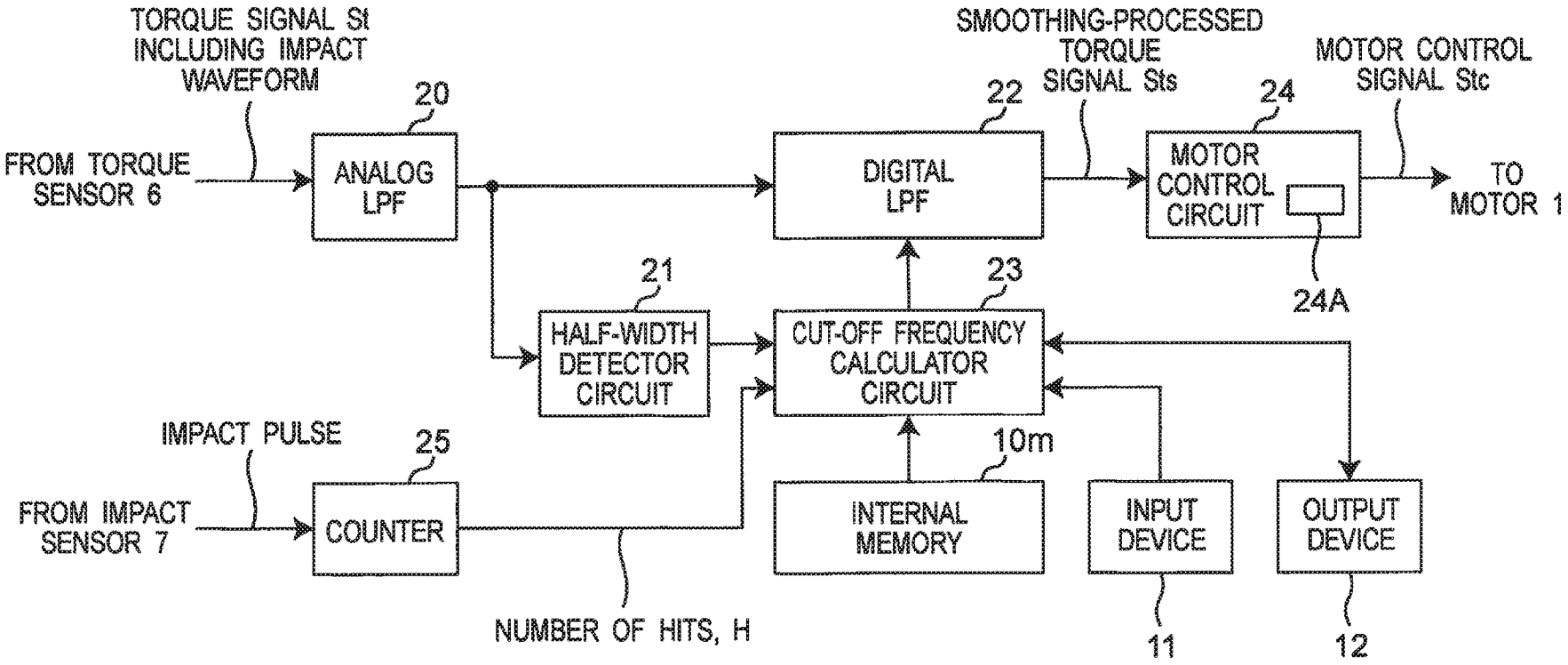
FIG. 17 is a block diagram illustrating a configuration example of a signal processing apparatus 10 for operation mode of FIG. 16.
Figure 18:
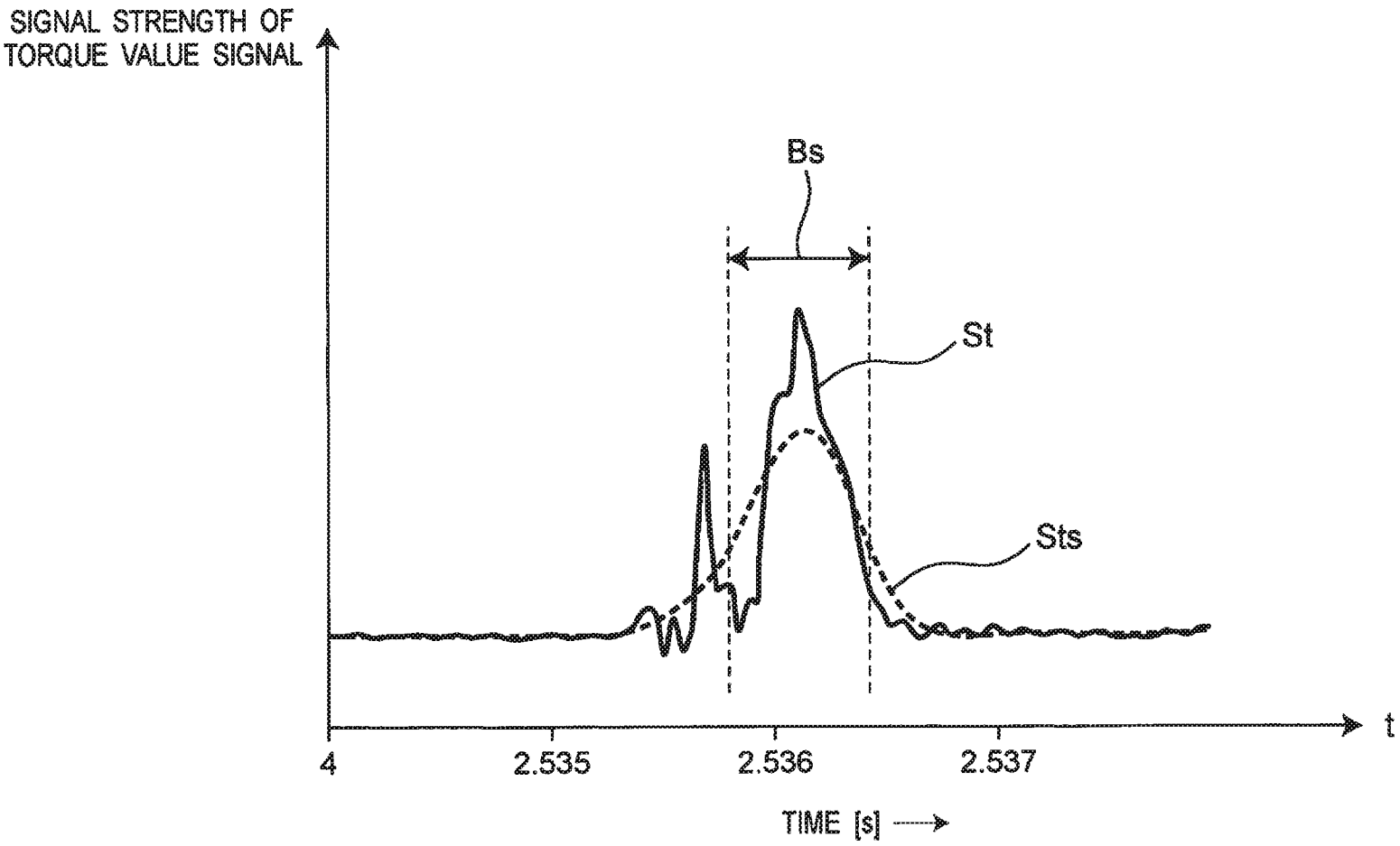
FIG. 18 is a waveform diagram of a torque value signal St, a torque value signal Sts subjected to a smoothing process, and a torque value signal indicating a half width Bs thereof in the impact electric tool according to the embodiment.

FIG. 17 is a block diagram illustrating a configuration example of the signal processing apparatus 10 for operation mode of FIG. 16. FIG. 18 is a waveform diagram of a torque value signal St, a torque value signal Sts subjected to smoothing processing, and a torque value signal indicating a half width Bs thereof in the impact electric tool according to the embodiment.

Referring to FIG. 17, the signal processing apparatus 10 for operation mode includes an analog low-pass filter (analog LPF) 20, a half width detector circuit 21, a digital low-pass filter (digital LPF) 22, a cut-off frequency calculator circuit 23, a motor control circuit 24 including a motor stop control unit 24A, a counter 25, and the internal memory 10*m*. It is noted that the internal memory 10*m* stores in advance the following data determined in the test mode:

(1) the approximate equation EQ1 representing a cut-off frequency fc with respect to the number of hits H from the start of hitting to a threshold number of hits Hth (until a half width Bs of FIG. 18 becomes constant); and (2) the approximate equation EQ2 representing the cut-off frequency fc with respect to the number of hits H from the threshold number of hits Hth to the end of hitting (after the half width Bs of FIG. 18 becomes constant).

It is noted that the input device 11 operates as input means for the user to select an optimum set from a plurality of sets of approximate equations EQ1 and EQ2 according to the type of impact electric tool. In addition, the display device 12 displays information such as the torque value signal St, the half width Bs, the cut-off frequency fc, and the number of hits H.

The analog low-pass filter 20 has a cut-off frequency sufficiently higher than the cut-off frequency fc of the digital low-pass filter 22, performs low-pass filtering on the torque value signal including the strike waveform from the torque sensor 6, and outputs the processed torque value signal to the half width detector circuit 21 and the digital low-pass filter 22. The half width detector circuit 21 detects the half width of the input signal, and outputs the detected half width to the cut-off frequency calculator circuit 23.

In addition, the counter 25 counts the number of impact pulses from the impact sensor 7 to count the number of hits H, and outputs the number of hits H to the cut-off frequency calculator circuit 23.

The digital low-pass filter 22 is, for example, a FIR digital filter, and the cut-off frequency fc is set by setting a plurality of predetermined filter coefficients. The digital low-pass filter 22 is set at the cut-off frequency fc specified by the cut-off frequency calculator circuit 23, and performs the smoothing process for removing the noise components of the strike waveform from the torque value signal St including the strike waveform. Then, the digital low-pass filter 22 outputs the processed torque value signal Sts to the motor control circuit 24. The cut-off frequency calculator circuit 23 operates as follows based on the half width Bs.

(1) From the start of hitting until the half width Bs becomes constant (until a predetermined threshold number of hits Hth is reached), the cut-off frequency calculator circuit 23 calculates the cut-off frequency fc calculated according to the number of hits H by using the approximate equation EQ1 stored in the internal memory 10*m*, and specifies the cut-off frequency fc for the digital low-pass filter 22.

(2) From when the half width Bs becomes constant until stop of hitting (until the predetermined threshold number of hits Hth is reached), the cut-off frequency calculator circuit 23 calculates the cut-off frequency fc calculated according to the number of hits H by using the approximate equation EQ2 stored in the internal memory 10*m*, and specifies the cut-off frequency fc for the digital low-pass filter 22.

The motor control circuit 24 generating a motor control signal Stc based on the input torque value signal Sts subjected to smoothing processing to control the impact applied to the anvil 4 and the shaft 5 by the motor 1. In addition, the motor control circuit 24 causes the motor stop control unit 24A to stop driving of the motor 1 when the torque value signal Sts becomes equal to or higher than a predetermined threshold value, for example.

Incidentally, in the torque value signal, the noise components are considered to have a frequency higher than the frequency of the signal component of interest. Therefore, it is expected that setting the cut-off frequency fc for the filter 22 is effective in reducing the noise components from the torque value signal. However, the inventors of the present application have discovered that when a certain screw or bolt is fastened by the impact driver, the frequency components on the higher frequency side in the torque value signal gradually increase in accordance with an increase in the number of hits counted from the start of fastening. It is considered that this is because the screw or the bolt is fastened more tightly in accordance with an increase in the number of hits. Therefore, in a case where a fixed cut-off frequency fc is set for the filter 22, there is possibility that the noise components are not appropriately reduced in the entire process from the start to the end of fastening. In the present disclosure, the signal processing apparatus 10 changes the cut-off frequency fc according to the number of hits H as described above. As a result, the signal processing apparatus 10 can obtain an accurate torque value signal filtered so as to appropriately reduce the noise components in the entire process from the start to the end of hitting.

Figure 19:
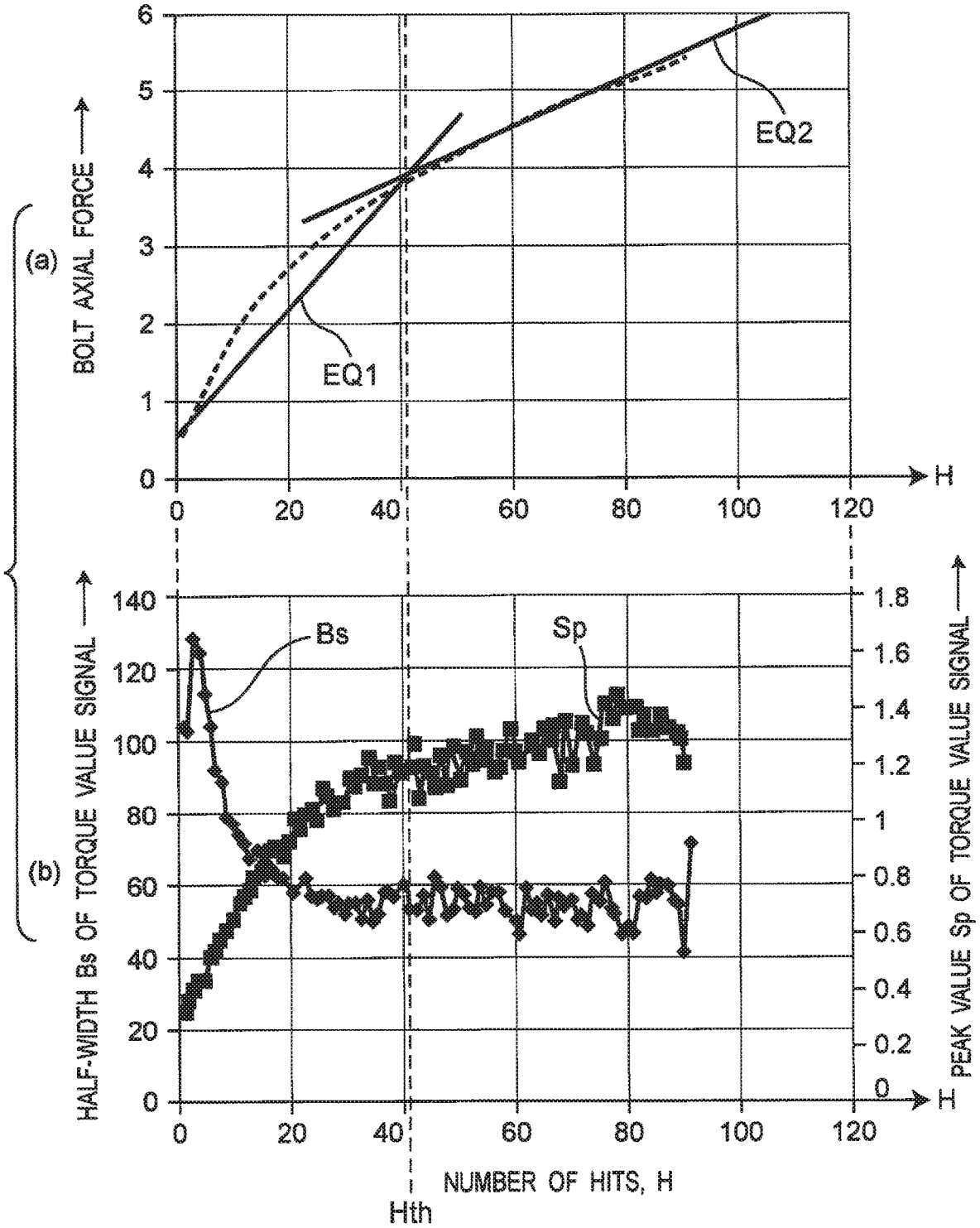
FIG. 19 is a graph illustrating a bolt axial force and a half width Bs and a peak value Sp of a torque value signal with respect to the number of hits H in the impact electric tool according to the embodiment.
Figure 20:
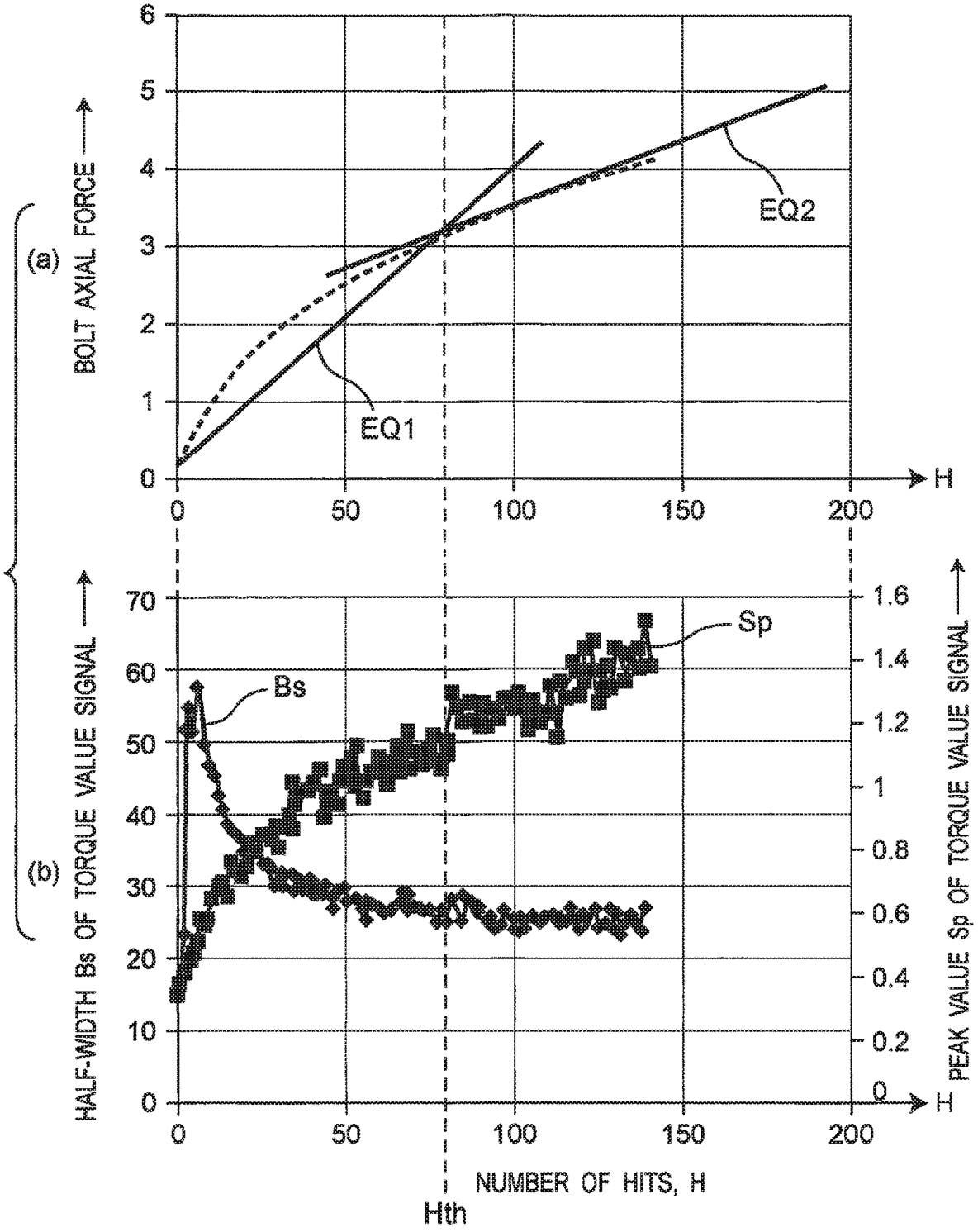
FIG. 20 is a graph illustrating a bolt axial force and a half width Bs and a peak value Sp of a torque value signal with respect to the number of hits H in the impact electric tool according to the embodiment.

FIG. 19 is a graph illustrating a bolt axial force and a half width Bs and a peak value Sp of a torque value signal with respect to the number of hits H in the impact electric tool according to the embodiment. In addition, FIG. 20 is a graph illustrating a bolt axial force and a half width Bs and a peak value Sp of a torque value signal with respect to the number of hits H in the impact electric tool according to the embodiment. As is apparent from FIGS. 19 and 20, in the case of using, for example, "M12 bolt, hard joint, socket length 40 mm", the change in the half width Bs of the torque value signal St decreases along with an increase in the bolt axial force, and becomes a constant value. In addition, it can be seen that the bolt axial force increases linearly after the half width reaches a constant value.

As described above, according to the present embodiment, based on the half width of the torque value signal detected by the half width detector circuit 21, the cut-off frequency fc of the digital low-pass filter 22 is controlled to be changed according to the number of hits H of the electric tool. Therefore, it is possible to obtain an accurate torque value signal filtered so as to appropriately reduce the noise components. As a result, the motor 1 of the electric tool can be appropriately controlled.

In the above-described embodiment, the digital low-pass filter 22 is used. However, the present disclosure is not limited to this, and a filter such as a band-pass filter, capable of reducing the frequency components equal to or higher than a predetermined cut-off frequency fc may be used.

The embodiments of the present disclosure are not limited to an impact power tool such as an impact driver, and are also applicable to other electric tools such as an impact wrench including a rotating body that rotates by being hit by a driving apparatus.

The invention claimed is:

1. A signal processing apparatus that generates a motor control signal for controlling a motor by performing a smoothing process on a torque value signal from a torque sensor of an electric tool by using a filter, the electric tool including a shaft and an anvil, the signal processing apparatus comprising:

an impact sensor that detects impact applied to the shaft due to a hit given to the anvil and the shaft and outputs an impact pulse indicating the detected impact;

a half width detector circuit that detects a half width of the torque value signal; and a calculator circuit that controls a cut-off frequency of the filter to change the cut-off frequency according to a number of hits of the electric tool, in which the number of impact pulses from the impact sensor is calculated as the number of hits, based on the detected half width of the torque value signal.

2. The signal processing apparatus as claimed in claim 1, wherein the calculator circuit calculates the cut-off frequency of the filter according to the number of hits of the electric tool, and sets the calculated cut-off frequency to the filter.

3. The signal processing apparatus as claimed in claim 2, wherein the calculator circuit calculates the cut-off frequency of the filter, by using first and second calculation functions for calculating the cut-off frequency of the filter according to the number of hits of the electric tool, and wherein the calculator circuit selectively switches over from the first calculation function to the second calculation function when the half width of the torque value signal becomes constant.

4. The signal processing apparatus as claimed in claim 3, wherein each of the first and second calculation functions is a linear approximate equation that is calculated based on a characteristic of the cut-off frequency of the filter with respect to the number of hits of the electric tool, the characteristic being detected in a test mode.

5. The signal processing apparatus as claimed in claim 1, wherein the filter is a FIR (Finite Impulse Response) type digital filter having a predetermined filter coefficient, and wherein the calculator circuit controls the cut-off frequency of the filter to change the cut-off frequency by controlling the filter coefficient.

6. The signal processing apparatus as claimed in claim 1, further comprising a motor control circuit generates a motor control signal for controlling the motor based on a signal obtained by performing the smoothing process on the torque value signal by using the filter.

7. An electric tool comprising a signal processing apparatus that generates a motor control signal for controlling a motor by performing a smoothing process on a torque value signal from a torque sensor of an electric tool by using a filter, the signal processing apparatus comprising:

a half width detector circuit that detects a half width of the torque value signal; and a calculator circuit that controls a cut-off frequency of the filter to change the cut-off frequency according to a number of hits of the electric tool, based on the detected half width of the torque value signal.

* * * * *